US005231970A

United States Patent [19]

Ploot et al.

[11] Patent Number: 5,231,970

[45] Date of Patent: Aug. 3, 1993

[54] ARCHERY BOW LIMB CONSTRUCTION

[75] Inventors: Terry Ploot, Hastings, Mich.; Virgil Denton, Morganton, N.C.

[73] Assignee: Pro Line Company, Hastings, Mich.

[21] Appl. No.: 881,484

[22] Filed: May 11, 1992

[51] Int. Cl.[5] ..... F41B 5/00

[52] U.S. Cl. ..... 124/23.1; 124/86; 403/356

[58] Field of Search ..... 124/23.1, 24.1, 25.6, 124/86, 88; 403/355, 356, 362, 365, 366, 375

[56] References Cited

U.S. PATENT DOCUMENTS

| | | | |
|---|---|---|---|
| 2,476,928 | 7/1949 | Thomas | 403/355 X |
| 3,560,031 | 2/1971 | Gilmour | 403/366 X |
| 3,821,946 | 7/1974 | Griggs | 124/23.1 |
| 3,942,506 | 3/1976 | Izuta . | |
| 4,061,124 | 12/1977 | Groner . | |
| 4,091,790 | 5/1978 | Hoyt, Jr. . | |
| 4,201,182 | 5/1980 | Butler | 124/25.6 |
| 4,285,305 | 8/1981 | Kaufman et al. | 403/356 X |
| 4,338,736 | 7/1982 | Radigan | 403/355 X |
| 4,494,521 | 1/1985 | Quartino . | |
| 4,574,766 | 3/1986 | Izuta . | |
| 4,793,319 | 12/1988 | Vaughan et al. . | |
| 4,984,931 | 1/1991 | Struthers et al. | 403/362 |

*Primary Examiner*—Randolph A. Reese
*Assistant Examiner*—John Ricci
*Attorney, Agent, or Firm*—Varnum, Riddering, Schmidt & Howlett

[57] ABSTRACT

A bow limb construction (51) includes a bushing (101) for use in mounting an archery bow limb (54) to an archery bow riser (52). The bushing can include a cylinder (116) which is adapted to be received in an aperture (71) of the bow limb. The bushing can include a vertically disposed flange (118) which is adapted to be received in a slot (70) in the bow limb. The bushing includes a first hole which extends vertically through the bushing, the first hole being adapted to receive a fastener (140) for adjustably securing the bow limb to the bow riser. Preferably, the first hole comprises a bore having an elliptical cross section. A major axis of the first hole is adapted to be aligned with a longitudinal axis of the bow limb. A second hole (160) can extend transversely through the bushing and communicate with the first hole. A set screw (162) can be threaded into the second hole so that the set screw adjustably bears against the fastener to retain the fastener in an adjusted position in the first hole.

13 Claims, 3 Drawing Sheets

ARCHERY BOW LIMB CONSTRUCTION

BACKGROUND OF THE INVENTION

1. Field of the Invention

This invention relates to an archery bow limb construction wherein a bow limb is mounted to a bow handle or riser.

2. Description of the Related Art

Referring to FIG. 1 of the attached drawings, a cross sectional view of a typical prior art bow limb construction 10 is shown. A bow limb 12 threadably engages a bow handle or riser 14 through a mounting screw 16 and a pair of ball mounts 18 (only one ball mount 18 is shown). The ball mounts 18 have a mushroom shape and comprise a cylindrical portion 20, an integral hemispherical portion 22, and an annular flange 23 which is integral with the outer periphery of the cylindrical portion 20. The cylindrical portion of each ball mount fits into a countersunk bore 24 in a bottom surface 25 in the bow limb, and the hemispherical portion of each ball mount snugly fits into a hemispherical recess 26 in the riser. The annular flange 23 engages the bottom surface 25 of the bow limb. A proximate and 28 of the bow limb pivots longitudinally with respect to the riser about the ball mounts. The bow limb can longitudinally pivot, for example, to and between a first position A shown in phantom lines and a second position B shown in solid lines by threading the mounting screw into the riser or unthreading the mounting screw out of the riser, respectively.

The mounting screw extends through an aperture 30 in the bow limb and is threadably received in a countersunk threaded bore 32 of the riser and adjustably secures the bow limb to the riser. A washer 34 includes a bore for receiving and supporting the mounting screw and can be disposed between the head of the mounting screw and the bow limb. The bore of the washer 34 has an inwardly tapering annular surface which leads to a generally cylindrical hole. The inwardly tapering annular surface of the washer 34 serves as a seat for an annular chamfer 36 of the mounting screw. A flat washer 35 can be disposed between the washer 34 and the bow limb. With this construction, the mounting screw is rotatably received by the washer 34.

The mounting screw can be threaded into the riser to draw the proximate end of the bow limb closer to the riser (position A), or the mounting screw can be unthreaded to move the proximate end of the bow limb farther from the riser (position B). During this adjustment of the mounting screw, the bow limb pivots about the ball mounts. This adjustment of each bow limb relative to the riser provides a range of angular relationships between each bow limb and the riser with corresponding differences in the amount of force imparted to the arrow for a given pull distance on the draw string, thereby adjusting the maximum draw force of the bow.

There are two problems which are experienced with this mounting, however. The first problem is that the limb tends to twist sideways or laterally with respect to the riser, thereby resulting in a misalignment of the bow during draw. The second problem is that the mounting screw tends to back out of the countersunk threaded bore of the riser, especially in high performance bows. Thus, the mounting screw must be continually adjusted.

There is a need for an archery bow limb construction wherein the maximum draw force of the bow can be adjusted. The tendency of the bow limb to twist laterally relative to the riser must be minimized. Also, it would be most preferably if the bow limbs did not require continual adjustment relative to the riser.

SUMMARY OF THE INVENTION

The invention provides an archery bow limb construction comprising an archery bow limb adapted to be adjustably mounted to a planar mounting surface of an archery bow riser. The bow limb includes a top surface, a bottom surface, a proximate end and a distal end. A slot and an aperture extend from the top surface of the bow limb to the bottom surface. The slot extends laterally from the proximate end of the bow limb toward the distal end and terminates at the aperture. A fastener can extend through the aperture and the planar mounting surface and be threadably received in the bow riser to adjustably secure the bow limb to the bow riser.

The improvement relates to a bushing which is received in the aperture of the bow limb. The bushing includes a first hole and a key which is snugly received in the slot of the bow limb. The first hole extends vertically through the bushing and is adapted to receive the fastener. The bushing can comprise a body portion and a head portion, and the body portion can comprise the key. The body portion can comprise a cylinder which is received in the aperture of the bow limb. The bow limb construction can include a washer which has a bore extending through it, wherein the bore communicates with the first hole of the bushing and is adapted to receive the fastener.

Preferably, a second hole extends transversely through the bushing and communicates with the first hole. A set screw is threaded into the second hole and adjustably bears against the fastener extending through the first hole to retain the fastener in an adjusted position in the first hole. The bow limb slot can be elongated, and the key can comprise an elongated flange. The first hole of the bushing preferably has an elliptical cross section. A major axis of the first hole is aligned with a longitudinal axis of the bow limb. The fastener can movably secure the bottom surface of the bow limb against the planar mounting surface of the bow riser. The bow limb can include a plurality of blind bores extending through the bottom surface of the bow limb and toward the top surface. The blind bores can receive pivot elements for pivotable mounting of the bow limb to the bow riser. Thus, the bow limb can be pivotably mounted to the bow riser.

The invention also relates to an archery bow including a riser, two of the bow limb constructions described above, two fasteners extending through the first holes of the bushings and into the riser to adjustably mount the bow limb to the riser, and a drawstring secured to the distal ends of the bow limbs. The planar mounting surface of the bow riser can include a plurality of hemispherical recesses which are axially aligned with the blind bores. The bow can include a plurality of ball mounts, each of which comprise a pillar-shaped element and an integral hemispherical-shaped element. The pillar-shaped elements can be received in the blind bores, and the hemispherical-shaped elements can be received in the hemispherical recesses so that the bow limb can be pivoted relative to the bow riser about the ball mounts.

The invention also relates to a bushing for use in mounting an archery bow limb to an archery bow riser. The bushing includes a lower portion which can be received in an aperture of the bow limb and a key secured to the lower portion, wherein the key is adapted to be snugly received in a slot of the bow limb. A first hole extends vertically through the bushing and is adapted to receive a fastener for adjustably securing the bow limb to the bow riser. The bushing can comprise a body portion and a head portion, wherein the body portion comprises the lower portion and the key. Preferably, a second hole extends transversely through the bushing and communicates with the first hole. A set screw can be threaded into the second hole and can adjustably bear against the fastener to retain the fastener in an adjusted position in the first hole. The lower portion preferably comprises a cylinder which is integral with the key. The key preferably comprises an elongated flange. The first hole can have an elliptical cross section. A major axis of the first hole is adapted to be aligned with a longitudinal axis of the bow limb.

In yet another aspect of the invention, a bushing is provided for use in mounting an archery bow limb to an archery bow riser. The bushing includes a lower portion which is adapted to be received in an aperture of the bow limb and a head portion secured to the lower portion. A first hole extends vertically through the head portion and the lower portion, the first hole being adapted to receive a fastener for adjustably securing the bow limb to the bow riser. A second hole extends transversely through the head portion and communicates with the first hole. A set screw is threaded into the second hole so that the set screw can adjustably bear against the fastener to retain the fastener in an adjusted position in the first hole. Preferably, the first hole has an elliptical cross section, and a major axis of the first hole is adapted to be aligned with a longitudinal axis of the bow limb.

The invention further relates to an archery bow which includes a central riser and two limbs mounted to the central riser, where at least one of the limbs is constructed as described above and is adjustably mounted to an end of the central riser. The archery bow can further comprise a washer like the one described above.

BRIEF DESCRIPTION OF THE DRAWINGS

The invention will now be described with reference to the drawings in which.

DETAILED DESCRIPTION OF THE PREFERRED EMBODIMENTS

Figure 2:
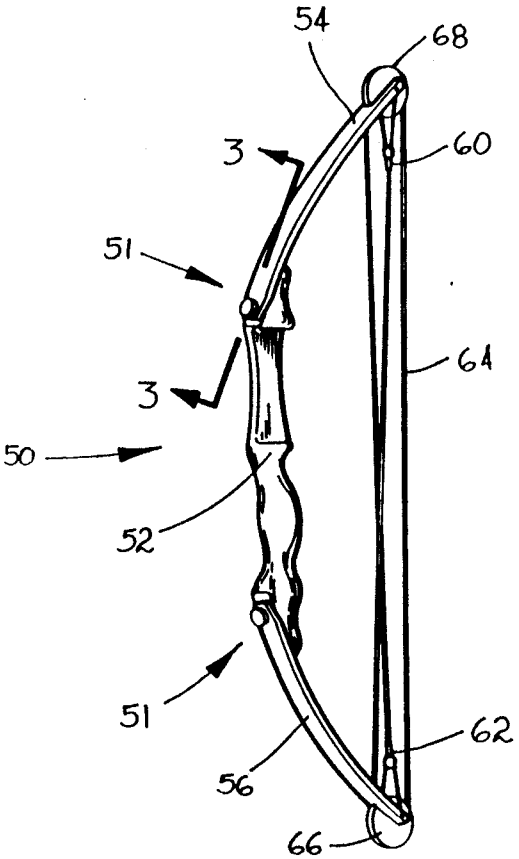
FIG. 2 is a front perspective view of an archery bow comprising a bow limb construction according to the invention.

The invention provides, as shown in FIG. 2, an archery bow 50 including two bow limb constructions 51. An upper limb 54 and a lower limb 56 are releasably attached to a central riser 52. Opposite ends 60, 62 of a drawstring 64 are attached to distal ends of the upper limb 54 and the lower limb 56 respectively. The drawstring 64 extends from the end 60 around a cam 66 rotatably mounted at the distal end of the lower limb 56. The other end 62 of the drawstring 64 is attached to the distal end of the lower limb 56 and extends around a cam 68 rotatably mounted at the distal end of the upper limb 54.

The bow limb construction 51 is provided at the proximate end of each bow limb 54, 56. Only the bow limb construction 51 for the upper limb 54 is shown in FIGS. 3–6 and referred to in the written description below although both such constructions are preferably the same.

Figure 4:
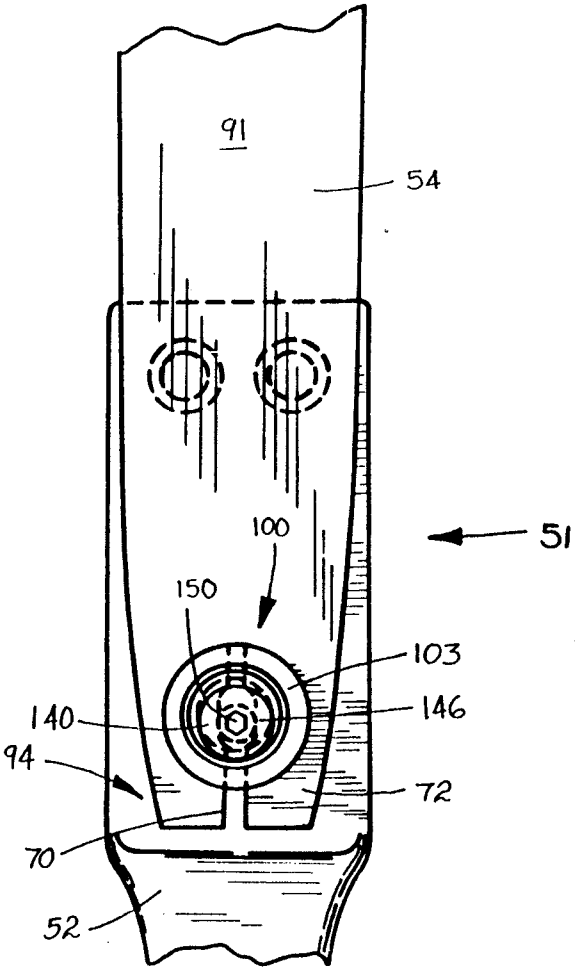
FIG. 4 is a front view of the bow limb construction according to the invention.
Figure 5:
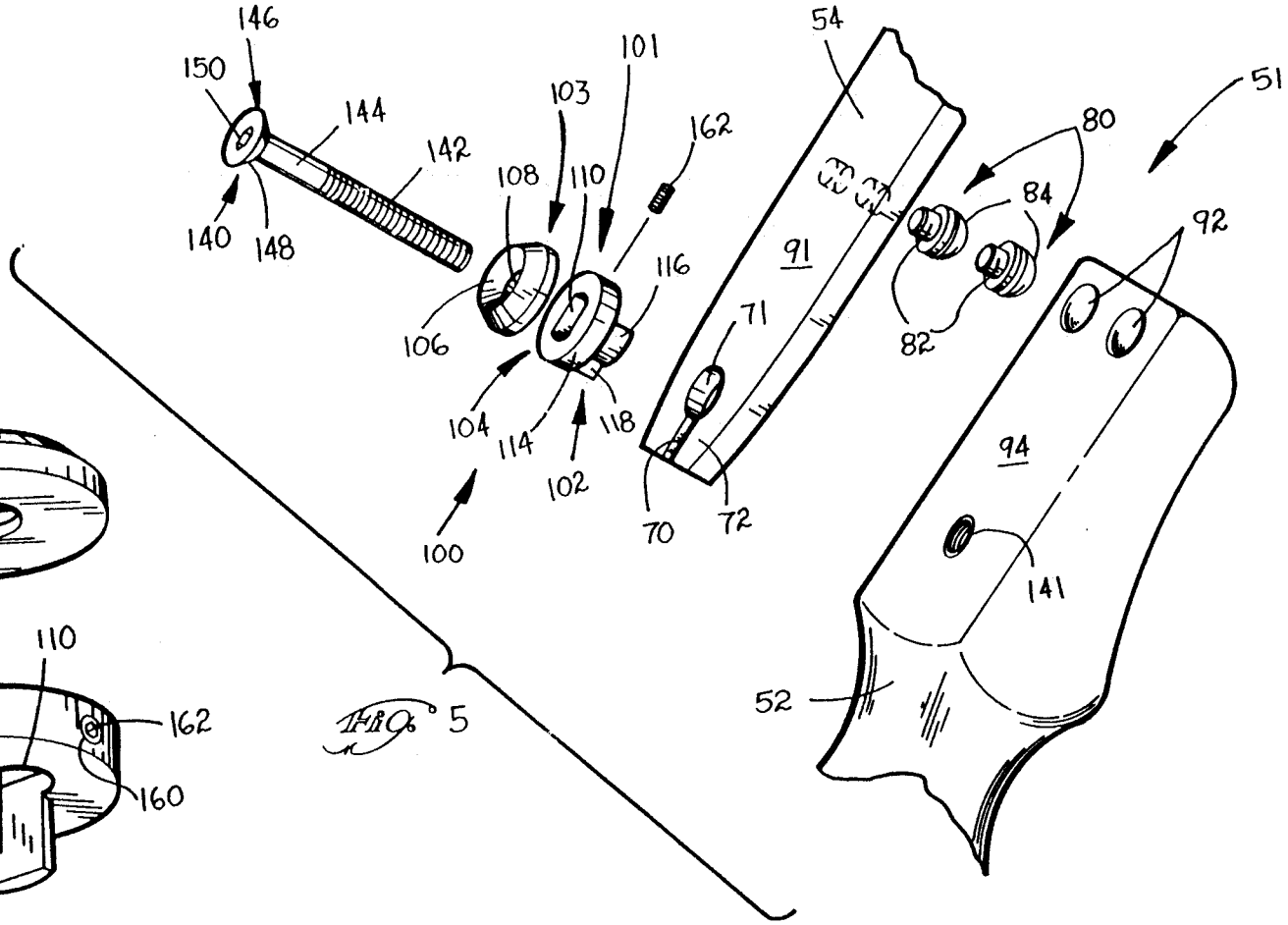
FIG. 5 is similar to FIG. 3 but is an exploded view.

As best shown in FIG. 4, the present invention requires a slot or notch 70 in a proximate end 72 of the bow limb 54. The slot 70 has a longitudinal axis extending in the same direction as the longitudinal axis of the riser 52. As best shown in FIG. 5, an aperture 71 extends through the bow limb 54 at a position adjacent to the slot 70. The aperture 71 and the slot 70 openly communicate.

Figure 3:
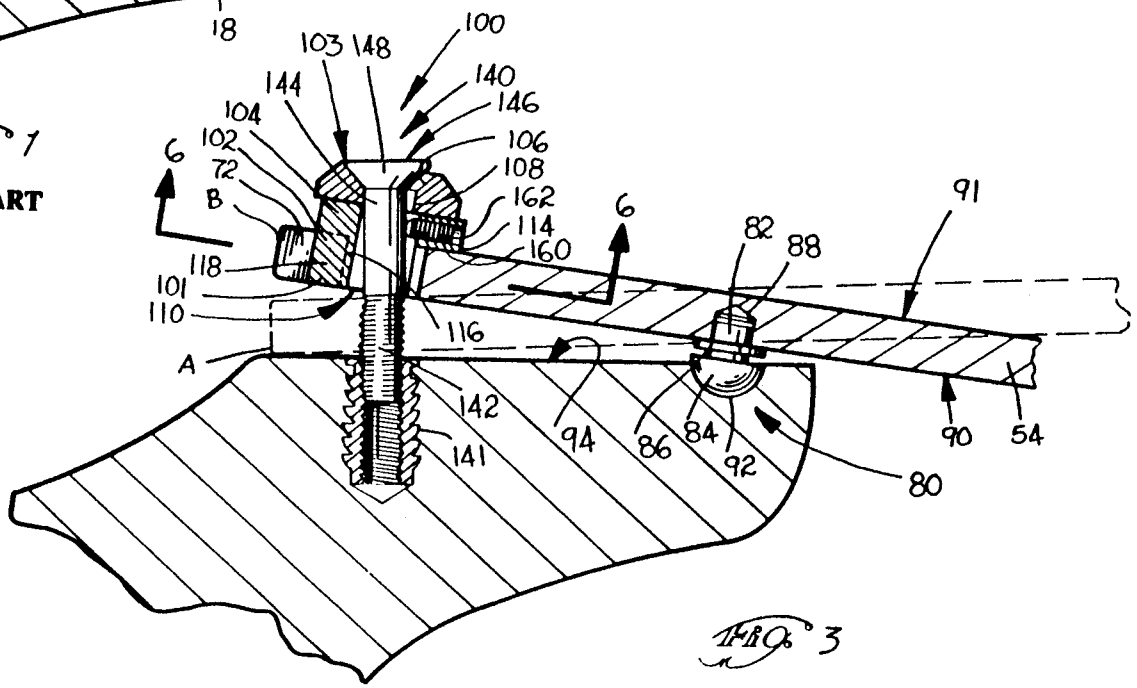
FIG. 3 is a cross section taken along lines 3—3 of FIG. 2, showing first and second positions of the bow limb relative to the riser in phantom lines and solid lines, respectively.

The bow limb construction 51 includes a pair of conventional ball mounts 80. As best shown in FIG. 3, the ball mounts 80 have a mushroom shape and comprise a cylindrical portion 82, a hemispherical portion 84 which is integral with the cylindrical portion 82, and an annular flange 86 which is integral with the outer periphery of the cylindrical portion 82. The cylindrical portion 82 of each ball mount 80 fits into a countersunk bore 88 which extends from a bottom surface 90 of the bow limb 54 toward a top surface 91 of the bow limb 54. As best shown in FIG. 5, the hemispherical portion 84 of each ball mount 80 snugly fits into a hemispherical recess 92 provided in a planar mounting surface 94 in the riser 52. Thus, the bow limb 54 pivots longitudinally with respect to the riser 52 about the ball mounts 80.

Figure 1:
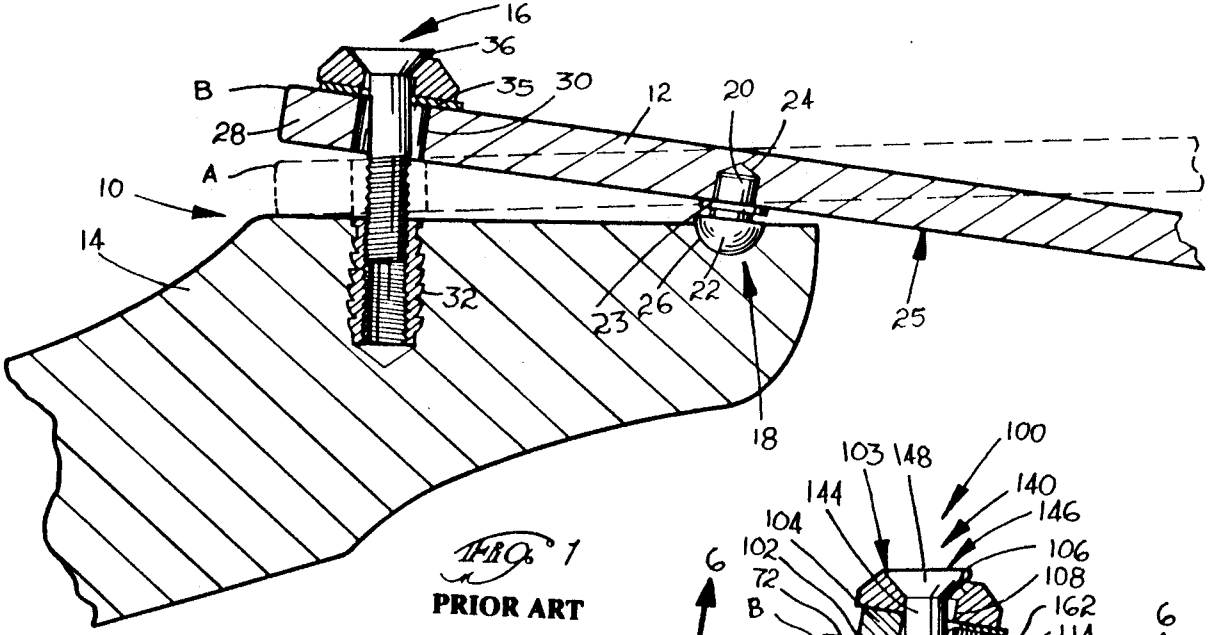
FIG. 1 PRIOR ART
FIG. 1 is a cross section through an archery bow riser and bow limb, showing a typical prior art mounting of the bow riser to the bow limb.

Referring to FIG. 5, the bow limb construction 51 includes a bushing assembly 100 which preferably comprises a bushing 101 and a washer 103. The bushing 101 comprises a body portion 102 and a head portion 104 which is integral with the body portion 102. The washer 103 is essentially the same as the washer 34 shown in FIG. 1. Thus, the washer 103 comprises a bore for receiving and supporting a mounting screw. The bore comprises an inwardly tapering annular surface 106 which leads to a generally cylindrical bore 108 (the bore 108 has a circular cross section). The inwardly tapering annular surface 106 serves as a seat for a head of a mounting screw. With this construction, a mounting screw can be rotatably received by the washer 103. If desired, a thin, flat washer (not shown) can be positioned between the washer 103 and the bushing 101.

Figure 6:
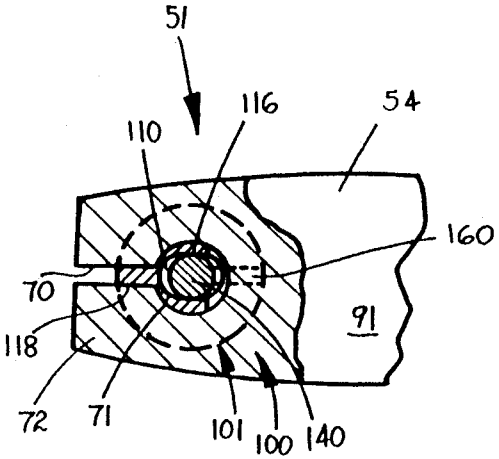
FIG. 6 is a horizontal section taken along lines 6-6 of FIG. 3.
Figure 7:
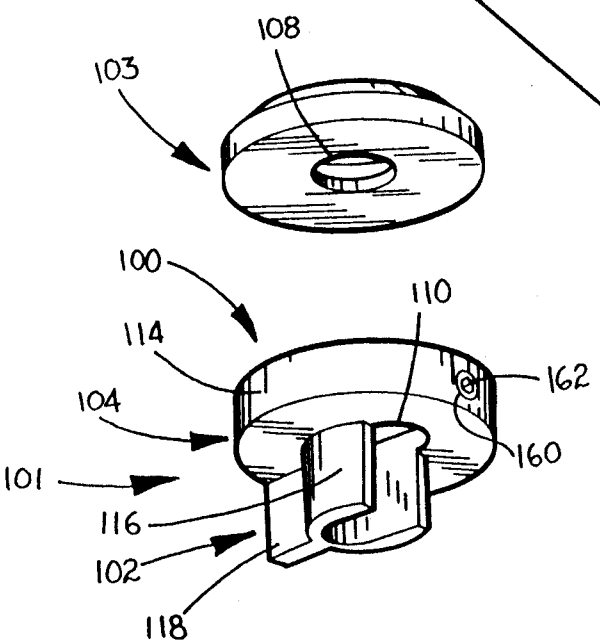
FIG. 7 is a perspective view of a bushing assembly according to the invention.

Referring to FIGS. 5 and 7, the head portion 104 of the bushing 101 comprises a large diameter cylinder 114. The body portion 102 comprises a small diameter cylinder 116 which has an open side at its end which is adapted to be disposed farthest from the proximate end 72 of the bow limb 54. The cylinders 114, 116 are integral. An elliptical bore 110 extends through the cylinders 114, 116 and is in communication with the generally cylindrical bore 108 which extends through the washer 103. A vertically disposed flange 118 extends radially outwardly from the exterior surface of the small diameter cylinder 116. Referring to FIG. 6, the flange 118 extends in the same direction as the major axis of the elliptical bore 110.

Turning again to FIG. 5, the aperture 71 of the bow limb 54 snugly receives the small diameter cylinder 116 of the bushing 101. The slot 70 of the bow limb 54 snugly receives the flange 118 of the bushing 101. Accordingly, the bushing 101 remains stationary with respect to the bow limb 54, and the major axis of the elliptical bore 110 (FIG. 6) of the bushing 101 extends in the same direction as the slot 70 of the bow limb 54.

Referring to FIG. 3, a mounting screw 140 is received in the washer 103 and bushing 101 of the bushing assembly 100 and is threadably received in a countersunk threaded bore 141 of the riser 52. The mounting screw 140 includes a threaded portion 142, a shank 144, a disk or head 146 which opposes the threaded portion 142, and an annular chamfer 148 extending from the shank 144 to the disk 146. The annular chamfer 148 of the mounting screw 140 seats against the inwardly tapering annular surface 106 of the washer 103. As shown in FIG. 4, the mounting screw 140 can include a hexagonal bore 150 which extends through the disk 146 and inwardly of the mounting screw 140. The hexagonal bore 150 is adapted to receive an Allen wrench (not shown) for purposes of threading or unthreading the mounting screw 140.

Referring to FIG. 3, the large diameter cylinder 114 of the bushing 101 includes a small threaded hole 160 extending laterally through the large diameter cylinder 114 and intersecting the elliptical bore 110. A set screw 162 can thread into the lateral hole 160 and movably bear against the shank 144 of the mounting screw 140. The set screw 162 retains the mounting screw 140 in the adjusted position (prevents the mounting screw 140 from backing out of the riser 52). The set screw 162 can be adjusted by use of an Allen wrench (not shown) and can be disengaged from the mounting screw 140 if it is desired to adjust the maximum draw force of the bow by threading the mounting screw 140 farther into the riser 52 or unthreading the mounting screw 140 farther out of the riser 52. Because the set screw 162 prevents the mounting screw 140 from backing out of the countersunk threaded bore 141 during use of the bow, the bow limb 54 does not need to be continually adjusted with respect to the riser 52.

Referring to FIG. 6, the flange 118 of the bushing 101 minimizes the tendency of the bow limb 54 to laterally twist with respect to the riser 52 (FIG. 2). The flange 118 prevents lateral twisting of the bow limb 54 by providing a large area of contact between the bushing 101 and the walls which define the slot 70 of the bow limb 54.

Also, the bushing 101 firmly holds the mounting screw 140 in the lateral direction and thereby prevents movement of the mounting screw 140 in the lateral direction. However, the mounting screw 140 can still be moved longitudinally of the elliptical bore 110. Further, refering to FIG. 3, the inwardly tapering annular surface 106 and the open side of the small diameter cylinder 116 permit the mounting screw 140 to tilt at an angle relative to the bushing assembly 100 as the mounting screw extends through the cylindrical hole 108 of the washer and the elliptical bore 110 of the bushing 101. Thus, the bushing assembly 100 provides for longitudinal pivoting of the bow limb 54 with respect to the riser 52 about the ball mounts 80 (longitudinal pivoting is considered desirable). At the same time, the elliptical bore 110 prevents lateral twisting of the bow limb 54 with respect to the riser 52.

Reasonable variation and modification are possible within the scope of the foregoing specification and drawings without departing from the spirit of the invention. The riser 52 can comprise wood or metal. Also, although the bushing assembly of the invention has been shown and described as a two piece assembly of the washer 103 and the bushing 101, it is contemplated that the bushing assembly could alternatively comprise one integral piece. At the present time, the two piece bushing assembly is believed to be the best construction.

We claim:

1. An archery bow limb construction comprising: an archery bow limb adapted to be adjustably mounted to a planar mounting surface of an archery bow riser, the bow limb comprising a top surface, a bottom surface, a proximate end and a distal end, wherein the bow limb includes a slot and an aperture, the slot and the aperture extending from the top surface to the bottom surface, the slot extending laterally from the proximate end toward the distal end and terminating at the aperture, and wherein a fastener extends through the aperture and is adapted to extend through the planar mounting surface and be threadably received in the bow riser to adjustably secure the bow limb to the bow riser, the improvement comprising:

a bushing received in the aperture, the bushing comprising a first hole and a key which is snugly received in the slot, wherein the first hole extends vertically through the bushing and is adapted to receive the fastener.

2. A bow limb construction according to claim 1 wherein the bushing comprises a body portion and a head portion, and the body portion comprises the key.

3. A bow limb construction according to claim 2 wherein the body portion comprises an open sided cylinder, the open sided cylinder being received in the aperture of the bow limb and permitting the fastener to extend at an angle through the first hole of the bushing.

4. A bow limb construction according to claim 1 wherein a second hole extends transversely through the bushing and communicates with the first hole, and wherein the bushing includes a set screw which is threaded into the second hole, the set screw being adapted to adjustably bear against the fastener extending through the first hole to retain the fastener in an adjusted position in the first hole.

5. A bow limb construction according to claim 1 wherein the slot is elongated, and the key comprises an elongated flange.

6. A bow limb construction according to claim 1 wherein the first hole of the bushing has an elliptical cross section, and a major axis of the first hole is aligned with a longitudinal axis of the bow limb.

7. A bow limb construction according to claim 1 wherein the fastener is adapted to movably secure the bottom surface of the bow limb against the planar mounting surface of the bow riser, and the bow limb includes a plurality of blind bores extending through the bottom surface and toward the top surface, wherein the blind bores are adapted to receive pivot elements for pivotably mounting the bow limb to the bow riser.

8. A bow limb construction according to claim 1 and further comprising a means to pivotably mount the bow limb to the bow riser.

9. An archery bow comprising:

a riser;

two archery bow limb constructions according to claim 1;

two fasteners extending through the respective first holes of the bushings and into the riser to thereby adjustably mount the proximate end of each bow limb to a respective end of the riser; and a drawstring secured to the distal ends of the bow limbs.

10. An archery bow comprising a bow limb construction according to claim 1, wherein the planar mounting surface of the bow riser includes a plurality of hemispherical recesses which are axially aligned with the blind bores, and wherein the bow includes a plurality of ball mounts, the ball mounts comprising a pillar-shaped element and an integral hemispherical-shaped element, and wherein the pillar-shaped elements are received in the blind bores and the hemispherical-shaped elements are received in the hemispherical recesses, whereby the bow limb can be pivoted relative to the bow riser about the ball mounts.

11. An archery bow comprising a central riser, and two limbs each mounted to the central riser, at least one of the limbs is constructed in accordance with claim 1 and is adjustably mounted to an end of the central riser.

12. A bow limb construction according to claim 1 further comprising a washer which has a bore extending through it, wherein the bore communicates with the first hole of the bushing and is adapted to receive the fastener.

13. An archery bow comprising a central riser, and two limbs each mounted to the central riser, at least one of the limbs is constructed in accordance with claim 12 and is adjustably mounted to an end of the central riser.

* * * * *